US010450638B2

(12) United States Patent
Kuroki et al.

(10) Patent No.: US 10,450,638 B2
(45) Date of Patent: Oct. 22, 2019

(54) AMORPHOUS ALLOY RIBBON AND METHOD FOR MANUFACTURING SAME

(71) Applicant: HITACHI METALS, LTD., Minato-ku, Tokyo (JP)

(72) Inventors: Morifumi Kuroki, Yasugi (JP); Kenichiro Hara, Yasugi (JP); Hajime Itagaki, Yasugi (JP)

(73) Assignee: HITACHI METALS, LTD., Tokyo (JP)

( * ) Notice: Subject to any disclaimer, the term of this patent is extended or adjusted under 35 U.S.C. 154(b) by 273 days.

(21) Appl. No.: 15/528,137

(22) PCT Filed: Nov. 20, 2015

(86) PCT No.: PCT/JP2015/082719
§ 371 (c)(1),
(2) Date: May 19, 2017

(87) PCT Pub. No.: WO2016/084741
PCT Pub. Date: Jun. 2, 2016

(65) Prior Publication Data

US 2018/0334737 A1 Nov. 22, 2018

(30) Foreign Application Priority Data

Nov. 25, 2014 (JP) ..... 2014-237705

(51) Int. Cl.
*C22C 45/02* (2006.01)
*B22D 27/04* (2006.01)
(Continued)

(52) U.S. Cl.
CPC ..... *C22C 45/02* (2013.01); *B22D 11/001* (2013.01); *B22D 11/0611* (2013.01);
(Continued)

(58) Field of Classification Search
CPC ... C22C 45/02; C22C 2200/02; C22C 33/003; H01F 1/15341; H01F 1/15308;
(Continued)

(56) References Cited

U.S. PATENT DOCUMENTS 5,958,153 A 9/1999 Sakamoto et al.
6,425,960 B1 7/2002 Yoshizawa et al.
(Continued)

FOREIGN PATENT DOCUMENTS

CN 1781624 A 6/2006
CN 101840764 A 9/2010
(Continued)

OTHER PUBLICATIONS

International Search Report for PCT/JP2015/082719 dated Feb. 16, 2016.

*Primary Examiner* — Anthony J Zimmer
(74) *Attorney, Agent, or Firm* — Nixon Peabody LLP; Jeffrey L. Costellia

(57) ABSTRACT

The present invention achieves an object of continuously supplying a melt from a melt nozzle over a long period of time by adjusting the contents of Mn and S in an Fe—B—Si—C-type amorphous alloy ribbon. An amorphous alloy ribbon of the present invention includes a composition containing Fe, Si, B, C, Mn, S, and inevitable impurities, the composition containing, with respect to 100.0 atm % of the total amount of Fe, Si, B, and C, 3.0 atm % or more and 10.0 atm % or less of Si, 10.0 atm % or more and 15.0 atm % or less of B, and 0.2 atm % or more and 0.4 atm % or less of C, the amorphous alloy ribbon having a content ratio of Mn of more than 0.12 mass % and less than 0.15 mass %, and a content ratio of S of 0.0036 mass % or more and less than 0.0045 mass %, the amorphous alloy ribbon having a
(Continued)

thickness of 10 μm or more and 40 μm or less, and a width of 100 mm or more and 300 mm or less.

4 Claims, 4 Drawing Sheets

(51) Int. Cl.

| | |
|---|---|
| ***B22D 11/06*** | (2006.01) |
| ***C21D 8/12*** | (2006.01) |
| ***C22C 33/00*** | (2006.01) |
| ***H01F 1/153*** | (2006.01) |
| ***B22D 11/00*** | (2006.01) |
| ***H01F 27/25*** | (2006.01) |

(52) U.S. Cl.
CPC ..... *B22D 11/0682* (2013.01); *B22D 11/0694* (2013.01); *B22D 27/04* (2013.01); *C21D 8/1211* (2013.01); *C22C 33/003* (2013.01); *H01F 1/15308* (2013.01); *H01F 1/15341* (2013.01); *C21D 2201/03* (2013.01); *C22C 2200/02* (2013.01); *H01F 27/25* (2013.01)

(58) Field of Classification Search
CPC ... H01F 27/25; B22D 11/001; B22D 11/0694; B22D 11/0682; B22D 11/0611; B22D 27/04; C21D 2201/03; C21D 8/1211
See application file for complete search history.

(56) References Cited

U.S. PATENT DOCUMENTS

| | | | | |
|---|---|---|---|---|
| 2009/0145524 | A1* | 6/2009 | Ogawa | H01F 1/15308 148/304 |
| 2009/0181259 | A1* | 7/2009 | Kurihara | B32B 15/08 428/458 |
| 2015/0050510 | A1 | 2/2015 | Motegi et al. | |

FOREIGN PATENT DOCUMENTS

| | | | |
|---|---|---|---|
| JP | 09-095760 | | 4/1997 |
| JP | 09-202946 | A | 8/1997 |
| JP | 09-263914 | A | 10/1997 |
| JP | 3494371 | | 2/2004 |
| WO | WO-2013-137118 | | 9/2013 |

* cited by examiner (a)

(b)

(c)

(a)

(b)

AMORPHOUS ALLOY RIBBON AND METHOD FOR MANUFACTURING SAME

TECHNICAL FIELD

The present invention relates to an amorphous alloy ribbon to be used as a material for a magnetic core or the like and a method of producing the amorphous alloy ribbon.

BACKGROUND ART

An amorphous alloy ribbon has excellent magnetic properties, and hence is utilized as a material for a magnetic core for power distribution or for a transformer, or a magnetic core for an electronic/electric circuit. When a magnetic core formed of a layered product of amorphous alloy ribbons is used, hysteresis loss and eddy current loss can be reduced, and hence no-load loss (core loss) can be reduced as compared to that of a transformer using silicon steel for its magnetic core.

An Fe-based amorphous alloy ribbon of an Fe—Si—B type or the like is used for the magnetic core for a transformer. In many cases, the amorphous Fe—Si—B-type alloy ribbon is produced by a liquid quenching method, in particular, a single-roll planer flow casting excellent in industrial producibility.

In the single-roll planer flow casting, an alloy material in a molten state (melt) is discharged onto a rotating chill roll, and the discharged melt is quenched and solidified on a surface of the chill roll. A production process of the amorphous alloy ribbon based on the single-roll planer flow casting is described in, for example, Patent Document No. 1.

CITATION LIST

Patent Literature

Patent Document No. 1: WO 2013/137118 A1
Patent Document No. 2: Japanese Patent Application Laid-Open Publication No. H9-95760

SUMMARY OF INVENTION

Technical Problem

A melt is generally fed onto a chill roll through a melt nozzle arranged in a bottom portion of a crucible in which the melt is retained. The melt nozzle has, as a melt orifice, for example, an opening of an elongated rectangular shape called a melt discharge slit. The shape of the melt discharge slit is appropriately designed depending on, for example, the width and thickness of an amorphous alloy ribbon to be formed.

In order to produce an amorphous alloy ribbon having a desired thickness and a desired surface configuration (properties), it is desired that the melt be fed in an appropriate amount and at an appropriate pressure onto the surface of the chill roll. In addition, in order to improve producibility, it has been required that the melt be continuously fed over a long period of time without interruption.

The present invention has been made in view of such problems, and a primary object of the present invention is to provide an amorphous alloy ribbon that can be produced with high producibility and a method of producing the amorphous alloy ribbon.

Solution to Problem

An amorphous alloy ribbon according to one embodiment of the present invention includes a composition containing Fe, Si, B, C, Mn, S, and inevitable impurities, the composition containing, with respect to 100.0 atm % of a total amount of Fe, Si, B, and C, 3.0 atm % or more and 10.0 atm % or less of Si, 10.0 atm % or more and 15.0 atm % or less of B, and 0.2 atm % or more and 0.4 atm % or less of C, the amorphous alloy ribbon having a content ratio of Mn of more than 0.12 mass % and less than 0.15 mass %, and a content ratio of S of more than 0.0034 mass % and less than 0.0045 mass %, the amorphous alloy ribbon having a thickness of 10 μm or more and 40 μm or less, and a width of 100 mm or more and 300 mm or less.

In one embodiment, the content ratio of S is 0.0036 mass % or more and 0.0044 mass % or less.

In one embodiment, the content ratio of Mn is 0.125 mass % or more and 0.145 mass % or less.

A method of producing an amorphous alloy ribbon according to one embodiment of the present invention includes the steps of: preparing a melt of a raw material alloy having a composition containing Fe, Si, B, C, Mn, S, and inevitable impurities, the composition containing, with respect to 100.0 atm % of a total amount of Fe, Si, B, and C, 3.0 atm % or more and 10.0 atm % or less of Si, 10.0 atm % or more and 15.0 atm % or less of B, and 0.2 atm % or more and 0.4 atm % or less of C, the raw material alloy having a content ratio of Mn of more than 0.12 mass % and less than 0.15 mass %, and a content ratio of S of more than 0.0034 mass % and less than 0.0045 mass %; and supplying the melt onto a chill roll through a melt discharge slit.

Advantageous Effects of Invention

According to the embodiment of the present invention, the amorphous alloy ribbon can be produced with a high producibility.

DESCRIPTION OF EMBODIMENTS

Now, an embodiment of the present invention is described. However, the present invention is not limited to the embodiment described below.

As a result of investigations made by the inventors of the present invention, it has been found that when Mn (manganese) and S (sulfur) are incorporated as additives or impurities into an Fe—B—Si—C-type amorphous alloy ribbon in amounts defined in the present invention, a melt can be continuously supplied from a melt nozzle over a long period of time.

A possible reason for this is that the incorporation of Mn and S in the amounts defined in the present invention restrains nonmetal matter that deposits on or adheres to a nozzle opening or a nozzle inner wall from becoming thick (growing). The reason is specifically described below.

Figure 1:
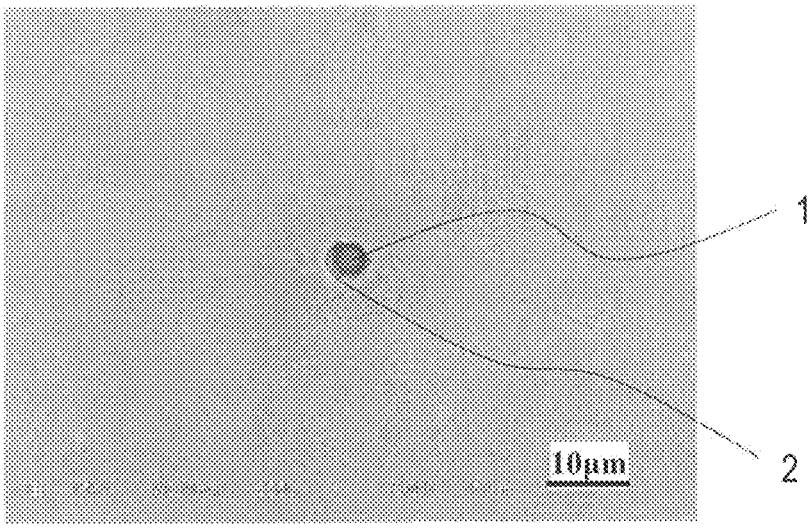
FIG. 1 is a cross-sectional SEM image of a sample collected from an alloy adhering to the neighborhood of a melt discharge slit of a melt nozzle after casting of an amorphous alloy ribbon.
Figure 2:
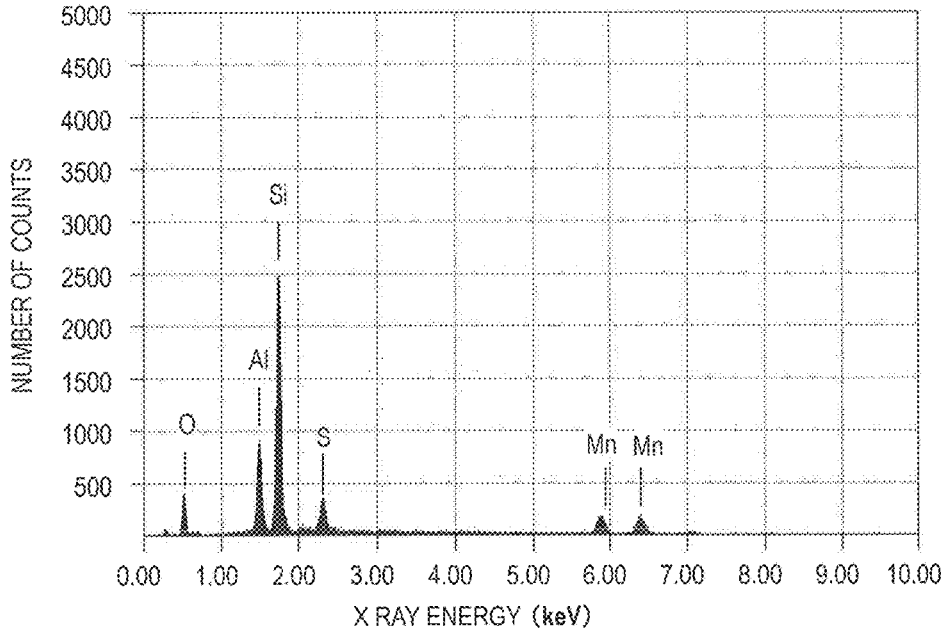
FIG. 2(*a*) is an EDX analysis result of an inside 1 of FIG. 1, FIG. 2(*b*) is an EDX analysis result of a surface layer portion 2 of FIG. 1, and FIG. 2(*c*) is a structure estimated from the results.
Figure 2:
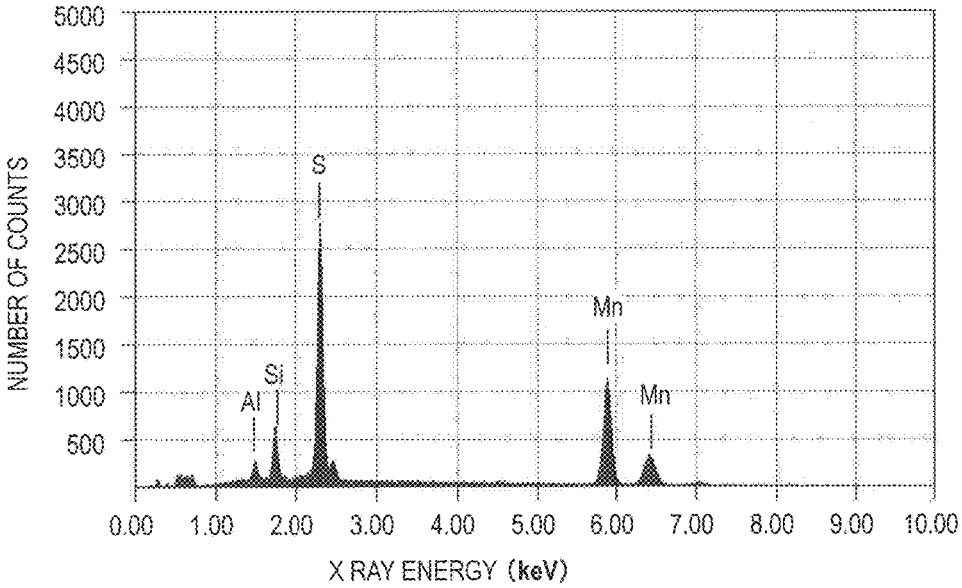
Figure 2:
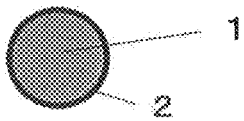

After casting of an amorphous alloy ribbon, part of the alloy adhering in a small amount to the neighborhood of a melt discharge slit of the melt nozzle was collected, and a cross-section of the collected sample was polished. In FIG. 1, a cross-sectional SEM image of the sample is shown. In addition, an inside 1 and a surface layer portion 2 of a cross-section of a spherical object, supposedly nonmetal matter, shown in FIG. 1 were subjected to EDX analysis. In FIG. 2(*a*) and FIG. 2(*b*), EDX analysis results for the inside 1 and the surface layer portion 2 are shown. As shown in FIG. 2(*a*), in the inside 1 of the spherical object, large peaks of Si, Al, and O were found. This suggests that the inside 1 is formed of oxides of Si and Al. In addition, as shown in FIG. 2(*b*), in the surface layer portion 2 of the spherical object, large peaks of Mn and S were found. This suggests that the surface layer portion 2 of the spherical object is formed of a compound MnS. In view of the foregoing, it is considered that, as illustrated in FIG. 2(*c*), the spherical object includes the inside 1 formed of the oxides of Si and Al, and the surface layer portion 2 covering the inside 1 and being formed of the compound MnS. In addition, because the surface layer portion 2 is formed of the compound MnS, it is considered that the oxides of Si and Al are restrained from undergoing grain growth (becoming thick).

The reason for the suppression of the growth of the Al and Si oxides due to the presence of the compound MnS is not known in detail, but the mechanism is supposedly as described below.

The melting points of the Al and Si oxides in the alloy melt are higher than the temperature of the alloy melt, and hence the Al and Si oxides are present as solids in the alloy melt. In addition, it is said that when the Al and Si oxides approach each other, an attractive force acts, with the result that the oxides are liable to aggregate with each other. In casting, the alloy melt passes through a narrow melt discharge slit. It is supposed that, during the passage, the oxides that have been increased in size through aggregation significantly influence the occlusion of the melt discharge slit. The compound MnS is present on the surface of the Al and Si oxides as shown in the analysis results of FIG. 2. Accordingly, it is supposed that the force making the oxides liable to aggregate with each other (aggregation force) that the surface of the Al and Si oxides originally has is suppressed, and the oxides are stabilized in a state of having initial (individual) sizes without aggregating.

It is considered that, as a result of the foregoing, the occlusion of the melt discharge slit is suppressed, and casting can be stably performed for a long period of time.

In addition, in the embodiment of the present invention, the fluidity of the alloy melt is improved by adding an appropriate amount of carbon (C) to the composition of the Fe—B—Si-type amorphous alloy ribbon. When the fluidity of the melt is enhanced by the addition of C as just described, and the occlusion of the melt discharge slit is suppressed by the addition of Mn and S, the Fe—B—Si amorphous alloy ribbon can be continuously produced over a long period of time.

In Patent Document No. 2, there is disclosed an Fe—B—Si—C-type amorphous alloy ribbon containing P, Mn, and S as impurities. However, in Patent Document No. 2, there is only a disclosure that the amorphous alloy ribbon is produced at relatively low cost through the use of a low-purity iron source containing Mn and S as impurities to some degree, and there is no suggestion that the contents of Mn and S are controlled to suppress the growth of the oxides by the action of the compound MnS, and thus the occlusion of the melt discharge slit is suppressed and the melt is stably fed for a long period of time.

Now, the composition of the amorphous alloy ribbon according to the embodiment of the present invention is described.

The amorphous alloy ribbon according to the embodiment of the present invention contains Fe, Si, B, and C. The amount of C with respect to 100.0 atm % of the total amount of Fe, Si, B, and C (hereinafter sometimes referred to simply as "amount of C") is 0.2 atm % or more and 0.4 atm % or less.

In addition, in the amorphous alloy ribbon according to the embodiment of the present invention, the amount of Si with respect to 100.0 atm % of the total amount of Fe, Si, B, and C (hereinafter sometimes referred to simply as "amount of Si") is 3.0 atm % or more and 10.0 atm % or less. The amount of Si may be 8.5 atm % or more and 9.5 atm % or less. When the amount of Si is 8.5 atm % or more, deterioration of the ribbon over time can be more effectively suppressed. When an excessively large amount of C is added to an Fe—B—Si-type amorphous alloy ribbon containing 8.5 atm % or more (in particular, 9.0 atm % or more) of Si, the ribbon tends to have increased brittleness. In contrast, in this embodiment, the amount of C is set to 0.4 atm % or less as described above, and hence the increase in brittleness of the ribbon is suppressed.

Meanwhile, when the amount of Si is more than 10.0 atm %, the amount of Fe is relatively small, and hence saturation magnetic flux density lowers. In addition, when the amount of Si is more than 10.0 atm %, amorphous phase formability tends to lower.

In addition, in the amorphous alloy ribbon according to the embodiment of the present invention, the amount of B with respect to 100.0 atm % of the total amount of Fe, Si, B, and C (hereinafter sometimes referred to simply as "amount of B") is 10.0 atm % or more and 15.0 atm % or less. The amount of B is preferably 10.0 atm % or more and 12.0 atm % or less.

When the amount of B is less than 10.0 atm %, crystallization temperature decreases, and the amorphous phase formability lowers. Meanwhile, an amount of B of more than 15.0 atm % is not preferred because raw material cost increases. In addition, from the viewpoint of further improving the amorphous phase formability, the amount of B is preferably 10.5 atm % or more, more preferably 11.0 atm % or more.

In the embodiment of the present invention, the amount of Fe with respect to 100.0 atm % of the total amount of Fe, Si, B, and C (hereinafter sometimes referred to simply as "amount of Fe") is not particularly limited. The remainder when Si, B, and C are set to the predetermined contents as described above may be Fe. The amount of Fe is, for example, more than 78.5 atm % and 81.5 atm % or less, preferably 79.0 atm % or more and 81.5 atm % or less, more preferably 79.0 atm % or more and 81.0 atm % or less, still more preferably 79.0 atm % or more and 80.5 atm % or less, particularly preferably 79.0 atm % or more and 80.0 atm % or less. When the amount of Fe is 81.0 atm % or less, the crystallization temperature further increases, and thermal stability further improves.

In addition, in the embodiment of the present invention, the amorphous alloy ribbon contains inevitable impurities in addition to the above-mentioned elements (Fe, Si, B, and C). As used herein, the term "inevitable impurities" refers to impurities that are inevitably mixed in the production process of the amorphous alloy ribbon, or a mother alloy or the alloy melt serving as a raw material therefor. Examples of the inevitable impurities include Cr, P, Ti, Ni, Al, Co, Zr, Mo, and Cu.

In addition, in the embodiment of the present invention, the amorphous alloy ribbon contains Mn and S. The content ratio of Mn is more than 0.12 mass % and less than 0.15 mass %, and the content ratio of S is more than 0.0034 mass % and less than 0.0045 mass %. The content ratios refer to ratios with respect to the entirety of the amorphous alloy ribbon.

When the content ratio of Mn is 0.12 mass % or less or the content ratio of S is 0.034 mass % or less, it is supposed that a layer of MnS for restraining nonmetal matter from becoming thick is not sufficiently formed and it becomes difficult to enable supplying of the melt over a long period of time.

Mn may be separately added to the raw material alloy or the melt as in the addition of ferromanganese (FeMn), and may be incorporated as an impurity in the production process of the mother alloy or the alloy melt serving as the raw material for the amorphous alloy ribbon. Therefore, the content of Mn may be the total of the amount of Mn incorporated into the raw material alloy, and the amount of separately added Mn. In addition, S may be separately added as in the addition of ferrosulfur (FeS), and may be incorporated as an impurity in the production process of the mother alloy or the alloy melt serving as the raw material for the amorphous alloy ribbon. Therefore, the content of S may be the total of the amount of S incorporated into the raw material alloy, and the amount of separately added S.

When the amounts of Mn and S contained as impurities in a raw material alloy are large, and the content ratio of Mn and the content ratio of S in the amorphous alloy ribbon are predicted to exceed the above-mentioned ranges, it is preferred that the raw material alloy be combined with another raw material alloy having low contents of Mn and S as impurities to adjust the content ratios within the above-mentioned ranges. Alternatively, the content ratios of Mn and S may be adjusted to the above-mentioned ranges by mixing a raw material alloy containing a large amount of Mn and/or S, and a raw material alloy containing a small amount of Mn and/or S.

In addition, the thickness (sheet thickness) of the amorphous alloy ribbon according to the embodiment of the present invention is 10 μm or more and 40 μm or less. When the thickness is less than 10 μm, the mechanical strength of the ribbon tends to be insufficient. The thickness is preferably 15 μm or more, more preferably 20 μm or more. Meanwhile, when the thickness of the ribbon is more than 40 μm, it tends to be difficult to stably obtain an amorphous phase. Accordingly, the thickness is preferably 35 μm or less, more preferably 30 μm or less.

In addition, the width of the amorphous alloy ribbon according to the embodiment of the present invention is, for example, 100 mm or more and 300 mm or less. When the width of the ribbon is 100 mm or more, a practical transformer can be suitably produced. The width of the ribbon is more preferably 125 mm or more. Meanwhile, when the width of the ribbon is more than 300 mm, a ribbon having a uniform thickness in its width direction is difficult to obtain, and there is a risk in that the non-uniform shape may result in partial brittleness, or in lowering of the saturation magnetic flux density (Bs). The width of the ribbon is more preferably 275 mm or less.

Figure 3:
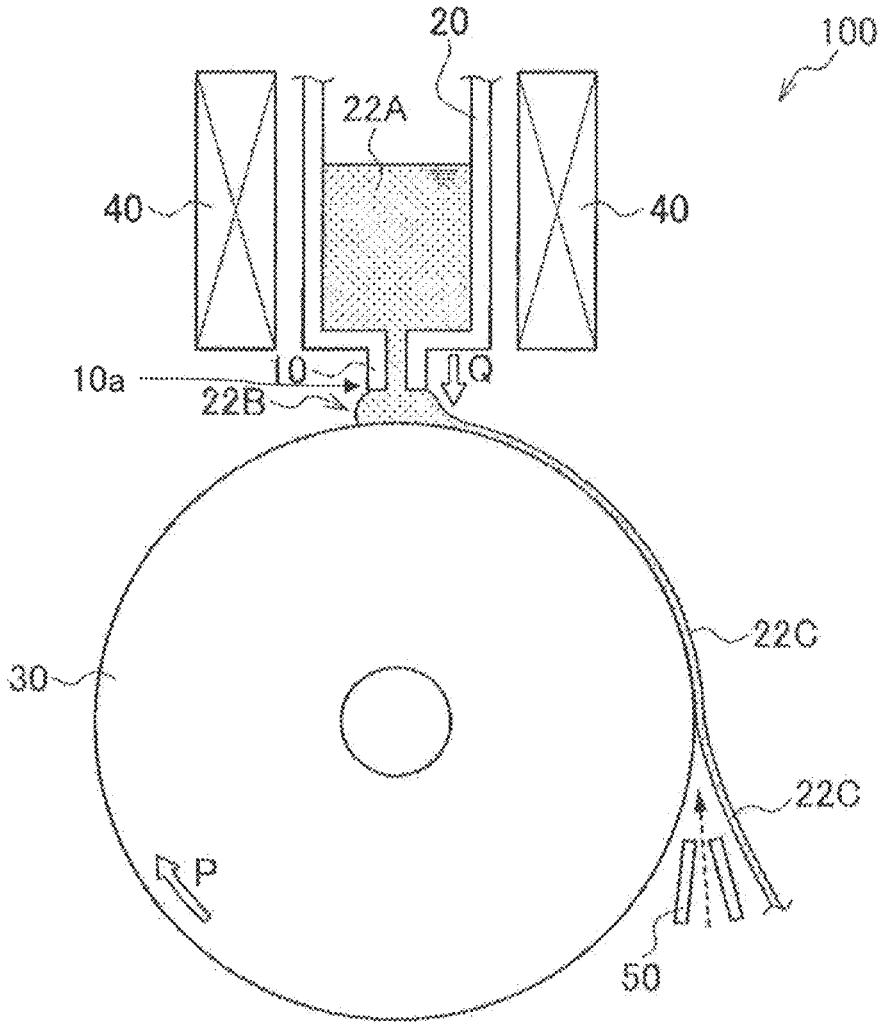
FIG. 3 is a cross-sectional view for illustrating an amorphous alloy ribbon producing apparatus to be used in an embodiment of the present invention.

FIG. 3 is a schematic cross-sectional view for conceptually illustrating one embodiment of an amorphous alloy ribbon producing apparatus (hereinafter sometimes referred to as "ribbon producing apparatus") to be suitably used for producing the amorphous alloy ribbon according to the embodiment of the present invention.

A ribbon producing apparatus 100 illustrated in FIG. 3 is a ribbon producing apparatus based on a single-roll planer flow casting.

As illustrated in FIG. 3, the ribbon producing apparatus 100 includes a crucible 20 including a melt nozzle 10, and a chill roll 30 having a surface opposed to the distal end of the melt nozzle 10. FIG. 3 is an illustration of a cross-section of the ribbon producing apparatus 100 taken along a plane perpendicular to the axial direction of the chill roll 30 and the width direction of the amorphous alloy ribbon 22C (these two directions are the same).

The crucible 20 has an inside space configured to accommodate an alloy melt 22A serving as a raw material for the amorphous alloy ribbon, and the inside space and a melt flow path in the melt nozzle 10 communicate to each other. With this, the alloy melt 22A accommodated in the crucible 20 can be discharged by the melt nozzle 10 onto the chill roll 30 (in FIG. 3, the discharge direction and flow direction of the alloy melt 22A are indicated by the arrow Q). The crucible 20 and the melt nozzle 10 may be integrally formed, or may be formed as separate bodies.

Around at least part of the periphery of the crucible 20, high-frequency coils 40 serving as heating means are arranged. With this, a mother alloy for the amorphous alloy ribbon in the crucible 20 in a state of accommodating the mother alloy can be heated to generate the alloy melt 22A in the crucible 20, or to maintain the liquid state of the alloy melt 22A fed to the crucible 20 from outside.

In addition, the melt nozzle 10 has a melt discharge slit 10*a* serving as a melt orifice for discharging the alloy melt. The melt discharge slit 10*a* preferably has an elongated rectangular shape. The long-side length of the rectangular shape is a length corresponding to the width of the amorphous alloy ribbon to be produced. Specifically, the long-side length of the rectangular shape is preferably 100 mm or more and 300 mm or less. The long-side length more preferably falls within the range of 125 mm or more and 275 mm or less. A standard long-side length of the melt discharge slit 10*a* is 142 mm, 170 mm, or 213 mm (±2 mm in each case). The short-side length of the melt discharge slit 10*a* is, for example, 0.1 mm or more and 1 mm or less.

The distance between the distal end of the melt nozzle 10 and the surface of the chill roll 30 is so short that when the alloy melt 22A is discharged from the melt discharge slit 10*a*, a puddle 22B of the alloy melt 22A is formed on the chill roll 30.

The distance may be set to a range within which the distance is generally set in the single-roll planer flow casting. The distance is preferably 500 μm or less, more preferably 300 μm or less. In addition, the distance is preferably 50 μm or more from the viewpoint of suppressing contact between the distal end of the melt nozzle 10 and the surface of the chill roll 30.

The chill roll 30 is configured to be capable of axial rotation in the direction of the arrow P. A cooling medium, for example, water is allowed to flow inside the chill roll 30, and with this, the alloy melt 22A discharged onto the surface of the chill roll 30 can be cooled to generate the amorphous alloy ribbon 22C.

The chill roll 30 is preferably formed of a material having high thermal conductivity, for example, Cu or a Cu alloy (e.g., a Cu—Be alloy, a Cu—Cr alloy, a Cu—Zr alloy, a Cu—Zn alloy, a Cu—Sn alloy, or a Cu—Ti alloy).

The diameter of the chill roll 30 is one of the factors determining a cooling time between the discharge of the alloy melt onto the chill roll and the stripping of the alloy ribbon from the chill roll, and is preferably 200 mm or more, more preferably 300 mm or more. Meanwhile, the diameter is more preferably 700 mm or less from the viewpoint of the maintainability of equipment.

In the neighborhood of the surface of the chill roll 30 (downstream of the melt nozzle 10 in the rotation direction of the chill roll 30), a stripping gas nozzle 50 is arranged. With this, stripping gas (e.g., nitrogen gas or high-pressure gas, such as compressed air) is blown in a direction opposite to the rotation direction of the chill roll 30 (arrow P) (in the direction of the broken-line arrow in FIG. 3), to thereby more efficiently perform the stripping of the amorphous alloy ribbon 22C from the chill roll 30.

The ribbon producing apparatus 100 may include constituents other than the above-mentioned constituents (e.g., a take-up roll configured to take up the produced amorphous alloy ribbon 22C, or a gas nozzle configured to blow $CO_2$ gas, $N_2$ gas, or the like against the puddle 22B of the alloy melt or the neighborhood thereof).

The ribbon producing apparatus 100 is not limited to the above-mentioned structure, and may have another known structure (e.g., a structure described in Japanese Patent No. 3494371 or the like).

Next, an example of a production process of the amorphous alloy ribbon 22C using the ribbon producing apparatus 100 is described.

First, the alloy melt 22A serving as the raw material for the amorphous alloy ribbon is prepared in the crucible 20. The composition and amounts of a mother alloy and an additive for obtaining the alloy melt 22A are appropriately selected so that the composition of the alloy ribbon to be formed may fall within the composition range of this embodiment described above. In this case, the alloy melt 22A may be an alloy melt obtained by melting a mother alloy containing Mn and S, or may be an alloy melt obtained by adding, to a melt obtained by melting the mother alloy, an appropriate amount of a Mn-containing material (e.g., ferromanganese (FeMn)) or a S-containing material (e.g., ferrosulfur (FeS)).

The temperature of the alloy melt 22A is not particularly limited. From the viewpoint of lowering the risk of nonmetal matter adhering to the inner wall surface of the melt nozzle 10 or the melt discharge slit 10*a*, the temperature is preferably 1,210° C. or more, more preferably 1,260° C. or more. In addition, from the viewpoint of suppressing the generation of an air pocket occurring on a surface brought into contact with the surface of the chill roll 30, the temperature of the alloy melt 22A is preferably 1,410° C. or less, more preferably 1,360° C. or less.

Next, the alloy melt is discharged from the melt nozzle 10 onto the surface of the chill roll 30 rotating in the direction of the arrow P to, while forming the puddle 22B, form a film of the alloy melt on the surface of the chill roll 30, and the film is cooled to provide the amorphous alloy ribbon 22C. Next, the amorphous alloy ribbon 22C formed on the surface of the chill roll 30 is stripped from the surface of the chill roll 30 by blowing stripping gas from the stripping gas nozzle 50, and is recovered by being taken up into a roll shape through the use of a take-up roll (not shown).

The operations starting with the discharge of the alloy melt and ending with the taking-up (recovery) of the amorphous alloy ribbon are continuously performed, and thus, an amorphous alloy ribbon of an elongate shape having, for example, a length in its longitudinal direction of 3,000 m or more is obtained.

In this case, the discharge pressure of the alloy melt 22A is preferably 10 kPa or more, more preferably 15 kPa or more. Meanwhile, the discharge pressure is preferably 30 kPa or less, more preferably 25 kPa or less.

In addition, the rotation speed of the chill roll 30 may be set to a range within which the rotation speed is generally set in the single-roll planer flow casting. The rotation speed is preferably 40 m/s or less in terms of peripheral speed, more preferably 30 m/s or less in terms of peripheral speed. Meanwhile, the rotation speed is preferably 10 m/s or more in terms of peripheral speed, more preferably 20 m/s or more in terms of peripheral speed. In addition, the rate of cooling of the alloy melt with the chill roll 30 is preferably $1\times10^5$ K/s or more, more preferably $1\times10^6$ K/s or more.

When only appropriate amounts of Mn and S are incorporated as described above, the clogging of the melt nozzle can be suppressed and an amorphous alloy ribbon having good properties can be continuously produced over a long period of time.

Now, Examples and Comparative Examples of the present invention are described.

In each of Examples E1 to E5 and Comparative Examples C1 to C4 shown in Table 1 below, an Fe—B—Si—C-type amorphous alloy ribbon was produced by a single-roll planer flow casting while the content ratios of Mn and S (mass % with respect to the whole amount of the amorphous alloy ribbon) were changed. The compositional ratios (atomic ratios) of Fe, B, Si, and C are common to all Examples and Comparative Examples, and with respect to 100.0 atm % of the total of Fe, B, Si, and C, Si accounts for 9.0 atm %, B accounts for 11.0 atm %, C accounts for 0.3 atm %, and the remainder is Fe (79.7 atm %).

In addition, for each of Examples E1 to E5 and Comparative Examples C1 to C4 having different content ratios of Mn and S, a continuous casting time was measured. As used herein, the term "continuous casting time" refers to a period of time between when a quenched amorphous alloy ribbon is first obtained by discharging a melt onto a chill roll through a melt nozzle and when the ribbon is interrupted. During the continuous casting time, a sufficient amount of the melt was accommodated in the crucible, and hence it was supposed that the ribbon was interrupted owing to narrowing or occlusion of the slit of the melt nozzle.

As the chill roll, a roll formed of a Cu—Be alloy and having a diameter of 400 mm was used. In addition, the size of the melt discharge slit (melt orifice) was 170 mm in its longitudinal direction and 0.5 mm in its lateral direction.

In Table 1 below, for each of Comparative Examples C1 to C4 and Examples E1 to E5, the content ratio of S (mass %), the content ratio of Mn (mass %), and the continuous casting time (min) are shown. In addition, FIG. 4(*a*) is a graph for showing a relationship between the content ratio of S (axis of abscissa) and the continuous casting time (axis of ordinate) in Table 1, and FIG. 4(*b*) is a graph for showing a relationship between the content ratio of Mn (axis of abscissa) and the continuous casting time (axis of ordinate) in Table 1.

The content ratios of S and Mn were measured in a sample collected from the melt before casting. In the sample, the content ratio of S may be measured by an infrared absorbing method in accordance with JIS G1211-3, and the content ratio of Mn may be measured by ICP emission spectroscopic analysis in accordance with JIS G1258-1.

TABLE 1

| | Continuous casting time [min] | S [mass %] | Mn [mass %] |
|---|---|---|---|
| C1 | 27 | 0.0030 | 0.12 |
| C2 | 28 | 0.0034 | 0.12 |
| C3 | 25 | 0.0027 | 0.11 |
| C4 | 30 | 0.0045 | 0.15 |
| E1 | 74 | 0.0042 | 0.13 |
| E2 | 68 | 0.0043 | 0.13 |
| E3 | 70 | 0.0043 | 0.14 |
| E4 | 77 | 0.0040 | 0.14 |
| E5 | 68 | 0.0037 | 0.14 |

Figure 4:
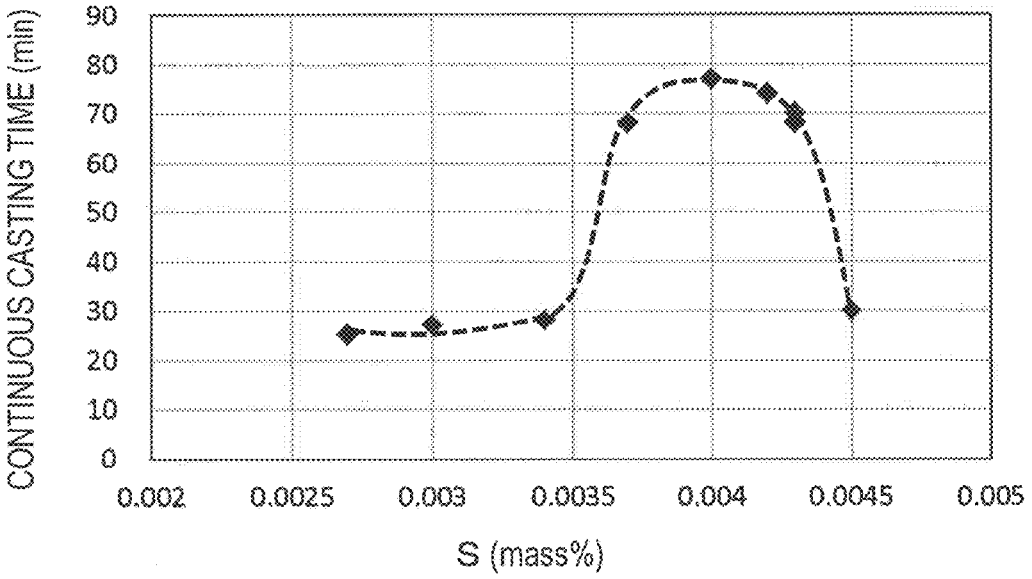
FIGS. 4(*a*) and (*b*) are graphs corresponding to Examples and Comparative Examples shown in Table 1, where FIG. 4(*a*) is a graph for showing a relationship between the content (mass %) of S (sulfur) and a continuous casting time (min), and FIG. 4(*b*) is a graph for showing a relationship between the content (mass %) of Mn (manganese) and a continuous casting time (min).
Figure 4:
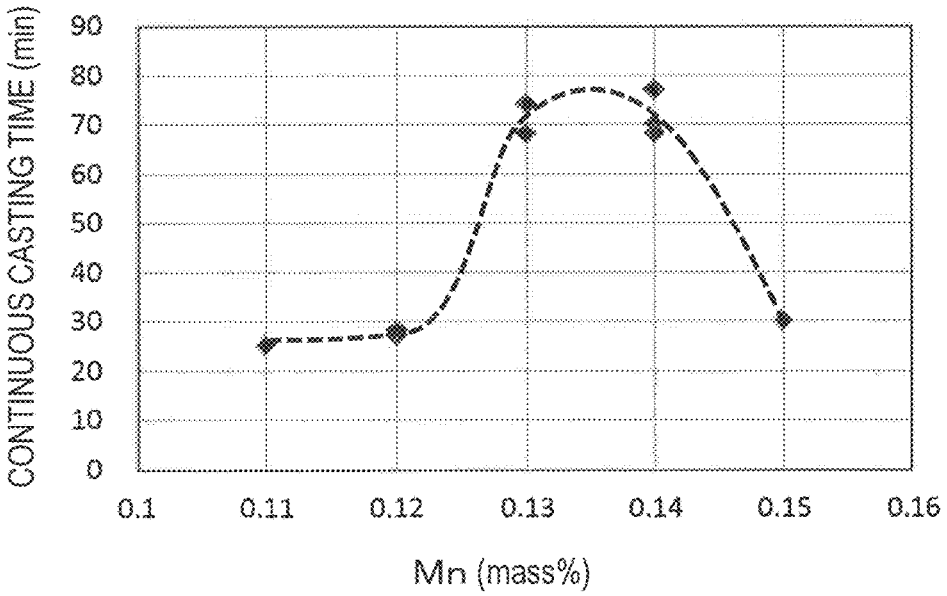

As apparent from Table 1 and FIG. 4(*a*), in the range of the content ratio of S of more than 0.0034 mass % and less than 0.0045 mass %, the continuous casting time is significantly long. In addition, it is inferred that the continuous casting time is 50 minutes or more in the range of 0.0036 mass % or more and 0.0044 mass % or less. In particular, in the range of Examples E1 to E5, i.e., the range of the content ratio of S of 0.0037 mass % or more and 0.0043 mass % or less, the continuous casting time was about 70 minutes or more, and thus it was confirmed that the amorphous alloy ribbon was able to be continuously cast without the occurrence of the occlusion of the melt discharge slit over a long period of time. Meanwhile, in each of Comparative Examples C1 to C4 falling outside the above-mentioned range, the continuous casting time is short. It is considered that nonmetal matter deposited to cause the occlusion of the slit early on.

In addition, as apparent from Table 1 and FIG. 4(*b*), in the range of the content ratio of Mn of more than 0.12 mass % and less than 0.15 mass %, the continuous casting time is significantly long. In addition, it is inferred that the continuous casting time is 50 minutes or more in the range of 0.125 mass % or more and 0.145 mass % or less. In particular, in the range of Examples E1 to E5, i.e., the range of the content ratio of Mn of 0.13 mass % or more and 0.14 mass % or less, the continuous casting time was about 70 minutes or more, and thus it was confirmed that the amorphous alloy ribbon was able to be continuously cast without the occurrence of the occlusion of the slit of the melt nozzle over a long period of time. Meanwhile, in each of Comparative Examples C1 to C4 falling outside the above-mentioned range, the continuous casting time is short. It is considered that nonmetal matter deposited to cause the occlusion of the slit early on.

INDUSTRIAL APPLICABILITY

The amorphous alloy ribbon according to the embodiment of the present invention is produced with high producibility and is suitably utilized for, for example, the production of a magnetic core for a transformer.

REFERENCE SIGNS LIST

1 inside
2 surface layer portion
10 melt nozzle
10*a* melt discharge slit
20 crucible
22A alloy melt
22B puddle
22C amorphous alloy ribbon
30 chill roll
40 high-frequency coil
50 stripping gas nozzle
100 amorphous alloy ribbon producing apparatus

The invention claimed is:

1. An amorphous alloy ribbon, comprising a composition containing Fe, Si, B, C, Mn, S, and inevitable impurities,
- the composition containing, with respect to 100.0 atm % of a total amount of Fe, Si, B, and C,
  - 3.0 atm % or more and 10.0 atm % or less of Si,
  - 10.0 atm % or more and 15.0 atm % or less of B, and
  - 0.2 atm % or more and 0.4 atm % or less of C,
- the amorphous alloy ribbon having
  - a content ratio of Mn of more than 0.12 mass % and 0.145 mass % or less, and
  - a content ratio of S of more than 0.0034 mass % and less than 0.0045 mass %,
- the amorphous alloy ribbon having a thickness of 10 μm or more and 40 μm or less, and a width of 100 mm or more and 300 mm or less.

2. The amorphous alloy ribbon according to claim 1, wherein the content ratio of S is 0.0036 mass % or more and 0.0044 mass % or less.

3. The amorphous alloy ribbon according to claim 1, wherein the content ratio of Mn is 0.125 mass % or more.

4. A method of producing an amorphous alloy ribbon, comprising the steps of:
- preparing a melt of a raw material alloy having a composition containing Fe, Si, B, C, Mn, S, and inevitable impurities,
  - the composition containing, with respect to 100.0 atm % of a total amount of Fe, Si, B, and C,
    - 3.0 atm % or more and 10.0 atm % or less of Si,
    - 10.0 atm % or more and 15.0 atm % or less of B, and
    - 0.2 atm % or more and 0.4 atm % or less of C,
  - the raw material alloy having
    - a content ratio of Mn of more than 0.12 mass % and 0.145 mass % or less, and
    - a content ratio of S of more than 0.0034 mass % and less than 0.0045 mass %; and
- supplying the melt onto a chill roll through a melt discharge slit.

* * * * *